US010054122B2

(12) United States Patent
Bissell et al.

(10) Patent No.: US 10,054,122 B2
(45) Date of Patent: Aug. 21, 2018

(54) METHOD OF CONVERTING LIQUID RING PUMPS HAVING SEALING LIQUID VENTS

(71) Applicant: Gardner Denver Nash, LLC, Trumbull, CT (US)

(72) Inventors: Douglas Eric Bissell, Monroe, CT (US); Charles Howard Beers, Milford, CT (US)

(73) Assignee: GARDNER DENVER NASH LLC, Charleroi, PA (US)

( * ) Notice: Subject to any disclaimer, the term of this patent is extended or adjusted under 35 U.S.C. 154(b) by 0 days.

(21) Appl. No.: 14/820,630

(22) Filed: Aug. 7, 2015

(65) Prior Publication Data

US 2015/0345495 A1 Dec. 3, 2015

Related U.S. Application Data

(63) Continuation of application No. 13/375,695, filed as application No. PCT/US2010/037080 on Jun. 2, 2010.

(Continued)

(51) Int. Cl.
*F04C 19/00* (2006.01)

(52) U.S. Cl.
CPC ..... *F04C 19/005* (2013.01); *F04C 19/008* (2013.01); *F04C 2220/20* (2013.01);
(Continued)

(58) Field of Classification Search
CPC ..... F04C 19/00; F04C 19/005; F04C 19/007; F04C 19/008
(Continued)

(56) References Cited

U.S. PATENT DOCUMENTS 4,498,844 A * 2/1985 Bissell ..... F04C 19/008 417/68
4,551,070 A 11/1985 Olsen et al.
(Continued)

FOREIGN PATENT DOCUMENTS

EP 1892419 A2 2/2008
GB 522964 A 7/1940
(Continued)

OTHER PUBLICATIONS

Applicant's Response to Written Opinion Filed Concurrently With a Demand regarding international companion case PCT/2010/037080, dated Apr. 21, 2011 (3 pgs.).
(Continued)

*Primary Examiner* — Peter J Bertheaud
(74) *Attorney, Agent, or Firm* — Michael Best & Friedrich LLP

(57) ABSTRACT

A conical member for a pump head of a liquid ring pump, the conical member including a body, the body defining a first body opening on a first end positioned to abut a first pump opening, a second body opening on the first end positioned to abut a second pump opening, and a port. The conical member further includes a radially outer lip arranged about the first end and positioned to abut a pump aperture. A sealing liquid introduction path is arranged to introduce sealing liquid to a working chamber, the sealing liquid introduction path arranged at least partially between the second body opening and an outlet, and a gas vent passage is arranged to vent gas from the working chamber, the gas vent passage arranged at least partially between the port and the first body opening.

3 Claims, 5 Drawing Sheets

Related U.S. Application Data

(60) Provisional application No. 61/220,904, filed on Jun. 26, 2009.

(52) U.S. Cl.
CPC ..... *F04C 2230/00* (2013.01); *Y10T 29/49238* (2015.01); *Y10T 29/49716* (2015.01)

(58) Field of Classification Search
USPC ..... 417/68
See application file for complete search history.

(56) References Cited

U.S. PATENT DOCUMENTS

| | | | |
|---|---|---|---|
| 4,565,498 | A | 1/1986 | Schmid et al. |
| 4,613,283 | A | 9/1986 | Haavik |
| 4,679,987 | A | 7/1987 | Olsen |
| 4,850,808 | A | 7/1989 | Schultze et al. |
| 5,356,268 | A | 10/1994 | Lengyel et al. |
| 2008/0038120 | A1 | 2/2008 | Lengyel et al. |

FOREIGN PATENT DOCUMENTS

| | | | |
|---|---|---|---|
| JP | S6060292 | A | 4/1985 |
| JP | S6243195 | U | 3/1987 |
| JP | S62271991 | A | 11/1987 |
| JP | H09166132 | A | 6/1997 |
| JP | H10213098 | A | 8/1998 |
| JP | 2008045551 | A | 2/2008 |

OTHER PUBLICATIONS

International Search Report related to companion case PCT/US2010/037080, dated Aug. 4, 2010 (3 pgs.).
Written Opinion of the International Searching Authority related to companion case PCT/US2010/037080, dated Aug. 4, 2010 (4 pgs.).
International Preliminary Report on Patentability related to companion case PCT/US2010/037080, dated Oct. 20, 2011 (3 pgs.).
Supplemental European Search Report from the European Patent Office for Application No. EP10792501 dated Oct. 6, 2016 (8 pages).

* cited by examiner

METHOD OF CONVERTING LIQUID RING PUMPS HAVING SEALING LIQUID VENTS

RELATED APPLICATIONS

This application is a continuation of co-pending U.S. patent application Ser. No. 13/375,695 filed on Dec. 1, 2011, which is the national phase of PCT Application No. PCT/US10/37080 filed on Jun. 2, 2010, which claims priority to U.S. Provisional Patent Application No. 61/220,904 filed on Jun. 26, 2009, the entire contents of all of which are incorporated herein by reference.

FIELD OF INVENTION

The present invention generally relates to a liquid ring pump ("pump") which vents sealing liquid (compressant) from the working chamber of the pump. More particularly, this invention relates to a method of converting liquid ring pumps using a sealing liquid venting system into a pump having a gas venting system in order to accommodate varying compression ratios.

BACKGROUND OF INVENTION

Liquid ring pumps are well known. U.S. Pat. No. 4,498,844, Bissell discloses a liquid ring pump with a conical port member. The conical port member has a vent re-circulation port in addition to the conventional intake and discharge ports. U.S. Pat. No. 4,498,844 is incorporated herein in its entirety.

The pump shown in FIG. 1 is of a known configuration of a conical liquid ring pump. FIG. 1 is a vertically oriented sectional view, taken along a plane parallel to the pump's shaft. FIG. 1*a* shows that the cross-section is taken along line 100. Cross section line 100 thus provides the perspective point for FIG. 1.

The pump has a first head 20 and a second head 22. Each head has a gas inlet 20*a*, 22*a*. Each head has a gas discharge 20*b*, 22*b*. The heads 20, 22 are located at the axial ends of the liquid ring pump. Located axially between the pump heads 20, 22 is a body or housing 23. Located within the housing is a rotor 25. The rotor 25 has rotor blades 25*a*. The rotor blades 25*a* extend from a hub 25*b*.

The body or housing 23 provides a chamber (working chamber) in which the rotor 25 rotates to draw air or gas 26 through gas inlets 20*a*, 22*a* into the working chamber. The gas 26 is then exhausted from the working chamber through gas discharge outlets 20*b*, 22*b*.

As can be seen, the gas 26 is drawn into the working chamber through conical port members 27, 28. The gas is also exhausted from the working chamber through conical port members 27, 28. The chamber is divided into a first working chamber 23*a* and a second working chamber 23*b* by rotor shroud 25*c* and lobe shroud 23*c*.

Sealing liquid 29, see FIG. 2, is in the working chamber. As the rotor 25 rotates, the sealing liquid 29 is formed into a liquid ring within the working chamber. The liquid ring takes an eccentric shape that diverges and converges in the radial direction relative to shaft 30 of the liquid ring pump. Where the sealing liquid 29 is diverging from the shaft 30, the resulting reduced pressure in the spaces between adjacent rotor blades of the rotor assembly (buckets) constitutes a gas intake zone. Where the sealing liquid 29 is converging towards the shaft 30, the resulting increased pressure in the spaces between the adjacent rotor blades (buckets) constitutes a gas compression zone. U.S. Pat. No. 4,850,808, Schultz, provides an example of a conical liquid ring pump. U.S. Pat. No. 4,850,808 is incorporated herein in its entirety.

The liquid ring pump shown in FIG. 1 has sealing liquid entry or introduction paths 31 which allow sealant 29 to enter the working chamber. The entering sealant 29 passes through the heads and conical port member. Although the sealing liquid 29 is shown entering only through head 20 and conical member 27, it could enter through head 22 and conical member 28.

In addition to having sealing liquid introduction pathways 31, the pump of FIG. 1 also has liquid vent paths to allow liquid to exit the working chamber during operation of the pump. Prior art FIG. 2 shows a schematic of sealing liquid 29 exiting the working chamber through sealing liquid vent path 33. The existing heads 20, 22 are symmetrical about the vertical axis permitting one head design to be used on either axial end of the pump. Depending on the direction of rotation, passages in the head are currently used for either introducing or venting the sealing liquid 29.

The design compression ratio is a ratio of the design discharge pressure to the design suction pressure. The operating compression ratio is a ratio of the operating discharge pressure to the operating suction pressure. In practice the pressure at discharge remains constant and is usually the atmospheric pressure. The suction pressure will vary depending on application.

It is known that a pump having a fixed discharge port and an operating compression ratio less than the design compression ratio will have increased pressure within the working chamber. Increased pressure requires the use of additional pump power. To minimize the need for increased pump power, the prior art, as shown in FIGS. 1 and 2 has compressant (sealing liquid) vent paths or built in liquid leakage paths to allow for the sealing liquid to exit the working chamber and reduce the pressure within the working chamber and within the buckets. Accordingly, the venting of the sealing liquid accommodates varying compression ratios experienced by the pump during operation.

The use of compressant or sealing liquid vent paths (liquid leakage paths) has several draw backs. Venting requires a balancing act of continually releasing and replenishing the seal liquid in order to achieve an appropriate pressure within the working chamber. If the seal liquid flow rate is increased over the normal flow rate, then the power control function of the liquid venting method is overcome and pump power can increase at low compression ratios where it can overload the drive system. Further a sudden drop in vacuum pressure from the design compression ratio to a low compression ratio results in a period in which the pump has more liquid in it than the steady state low compression ratio condition. The excess liquid can result in overloads to the drive equipment. Also, if the seal liquid to the pump is reduced, the flow out through the liquid vent paths results in diminished sealing within the pump and the gas volume pumped is reduced.

SUMMARY OF INVENTION

The disclosure provides for the conversion of a liquid ring pump which utilizes sealing liquid venting, into a pump which utilizes gas venting. Gas venting avoids the pitfalls associated with sealing liquid venting because, in part, it eliminates the need to continually introduce and release sealing liquid. Instead, when the pump is operating at a compression ratio less than the design compression ratio, gas can be vented from the working chamber of the pump to reduce the over compression. In return, this also reduces the shaft power requirements. The conversion of existing liquid ring pumps can be done through only minimal changes to the pump parts.

A sealing liquid pathway of a liquid ring pump, either used for sealing liquid venting or sealing liquid introduction, is retasked to form a portion of a gas vent. The present disclosure shows retasking a sealing liquid introduction path in a pump head to provide a portion of a gas vent path. The disclosure also provides for converting a sealing liquid vent path of an existing liquid ring pump into a sealing liquid introduction path.

Converting the sealing liquid vent path to a sealing liquid introduction path requires providing a new cone which seals off a portion of the vent path extending through the pump head. The new cone also provides a new channel to allow for the entry of sealing liquid into the working chamber from a pathway in the pump head previously used to form a portion of the sealing liquid vent path. Of course the path retasked to be a sealing liquid introduction path would be repiped to receive sealant.

To provide for the gas vent, the pump head passage previously used for sealing liquid introduction is retasked so that it forms a portion of an appropriately sized passage way to vent gas to the pump discharge. Additionally, the new cone is provided with a vent passage which aligns with an opening in the pump head which was previously an opening for sealing liquid introduction but is now retasked to form an opening into a gas vent in the pump head. The new cone gas passage has a gas port through the cone's conical surface.

The retasked and converted pump permits operation with reduced seal flow to the pump because the pump no longer relies on sealing liquid venting to accommodate varying compression ratios. Additionally, the retasking allows the pump to operate with sealing volume flow rates greater than or equal to 200% of the pump prior to retasking over the entire operating vacuum range of the pump without increasing the power requirements above those of the prior pump. Accordingly, the retasked pump is insensitive to a doubling of seal rate and insensitive to quick drops in vacuum.

DETAILED DESCRIPTION

Figure 2:
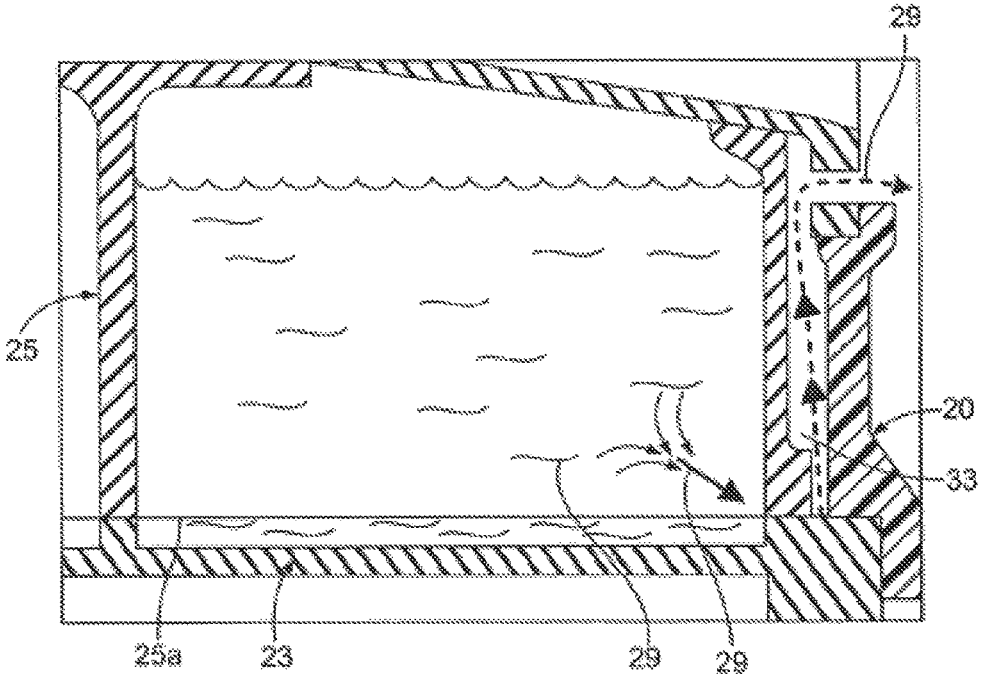
FIG. 2 (Prior Art)
FIG. 2 is a rough schematic of a blown up portion of the pump shown in FIG. 1 showing a sealing liquid vent path which allows discharge of sealing liquid around the rotor periphery.
Figure 3:
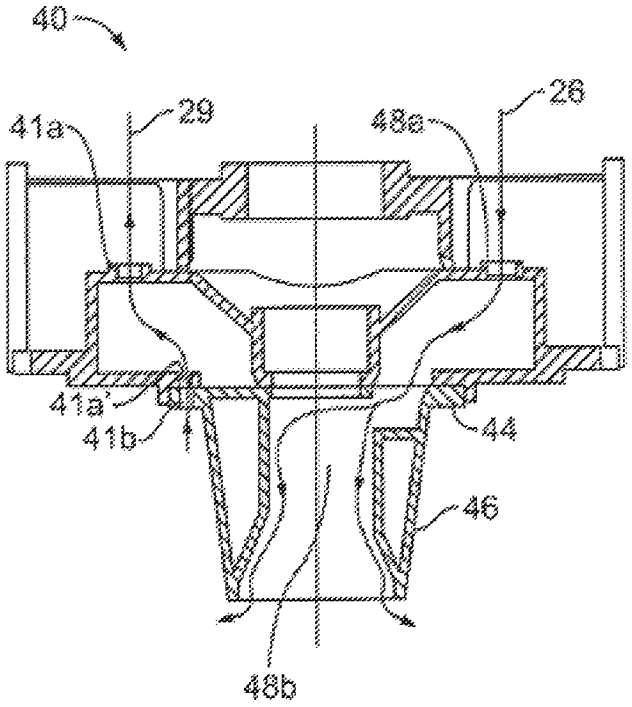
FIG. 3 (Prior Art)
FIG. 3 is a stripped down horizontal sectional view of a pump of the type shown in FIG. 1 taken along a plane parallel to the pumps shaft; the Figure includes a pump head interfaced with a conical member.
Figure 5:
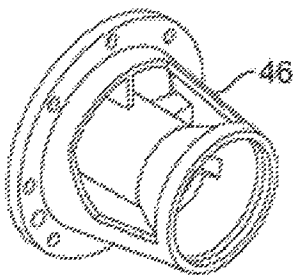
FIG. 5 (Prior Art)
FIG. 5 is an isometric view of the conical member shown in FIG. 3.
Figure 6:
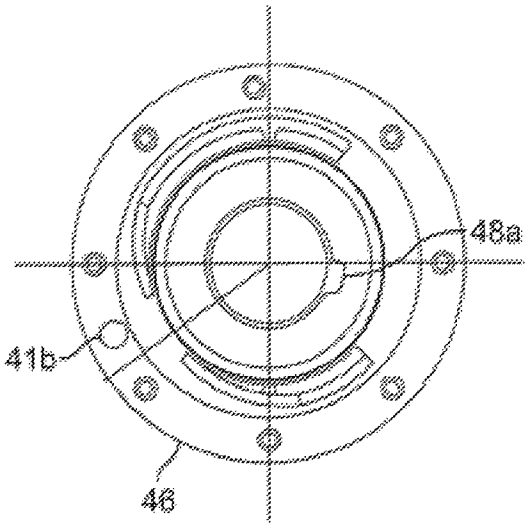
FIG. 6 (Prior Art)
FIG. 6 is an end view of the conical member shown in FIG. 5 looking into the nose or small end of the cone.

The present invention converts a pump, which relies on sealing liquid vent paths, also known as liquid leakage paths, into a pump which utilizes a gas vent path. The gas vent path is now used to accommodate varying compression ratios, instead of the sealing liquid vent path. Prior to conversion of the pump, the pump can have all of the features shown in FIGS. 1, 2 and 3. Prior to conversion, FIG. 3 shows a pump head 40 which has a sealing liquid (compressant) vent passage. The vent path or passage is formed by a channel 41*a* extending through pump head 40 and an aperture 41*b* extending through a flange 44 of conical member 46. The vent path allows unwanted sealing liquid 29 to exit the working chamber.

Prior to conversion, the pump head 40 also has a sealing liquid introduction passage. The seal liquid introduction passage is formed by a channel passage 48*a* extending through pump head 40 and a channel 48*b* extending through conical member 46.

Figure 1:
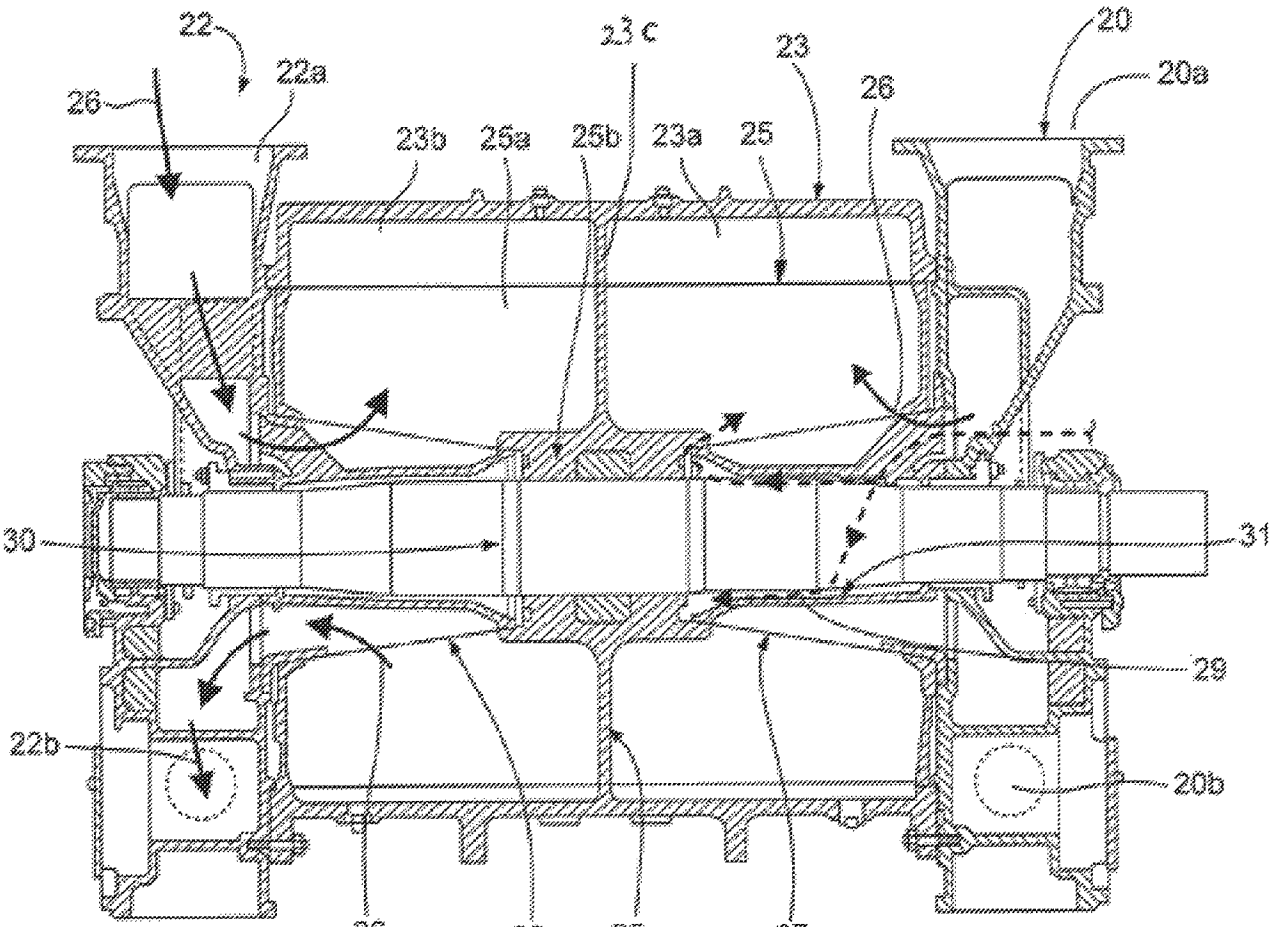
FIG. 1 (Prior Art)
FIG. 1 is a vertical sectional view of a prior art liquid ring pump taken along a plane parallel to the shaft of the pump.
Figure 1A:
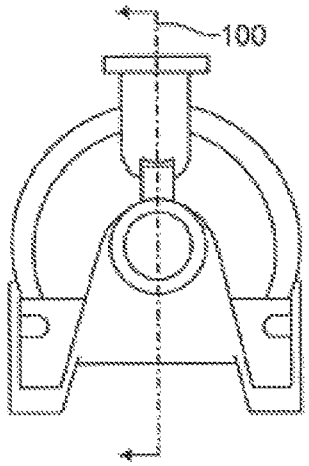
FIG. 1A (Prior Art)
FIG. 1*a* is an end view of a pump head of the type shown in FIG. 1.
Figure 4:
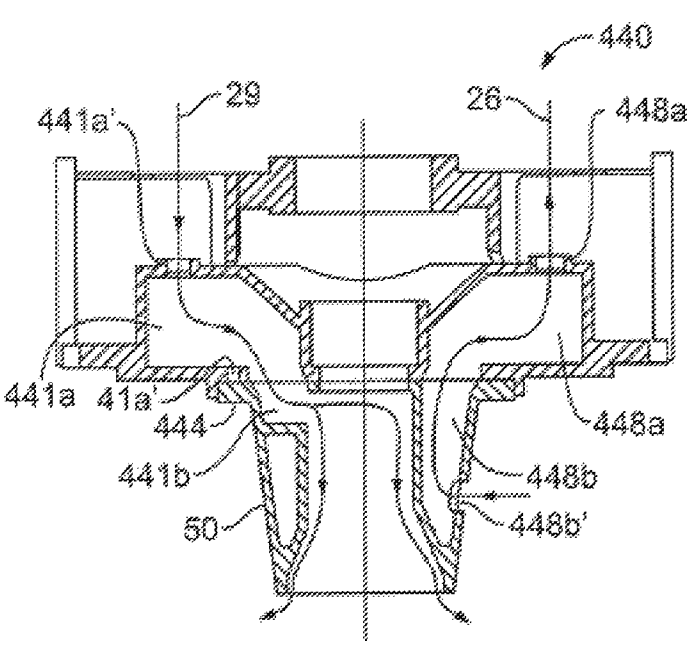
FIG. 4 is a horizontal sectional view through a liquid ring pump taken in a manner similar to the section of FIG. 3; the pump head and cone have been reconfigured in accordance with the present invention to allow gas to be vented in a channel previously used for sealing liquid introduction.
Figure 7:
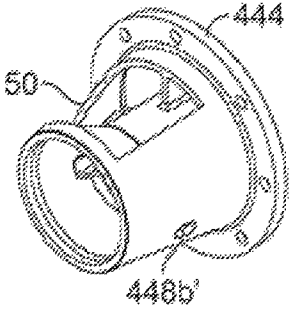
FIG. 7 is an isometric view of the cone shown in FIG. 4.
Figure 8:
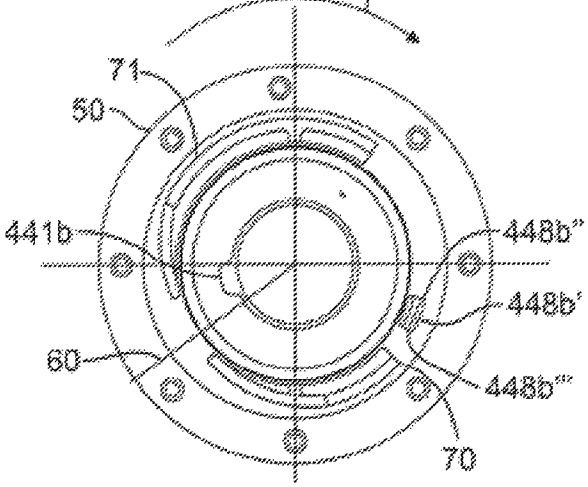
FIG. 8 is an end view of the cone shown in FIG. 7 looking into the nose or small end of the cone.
Figure 10:
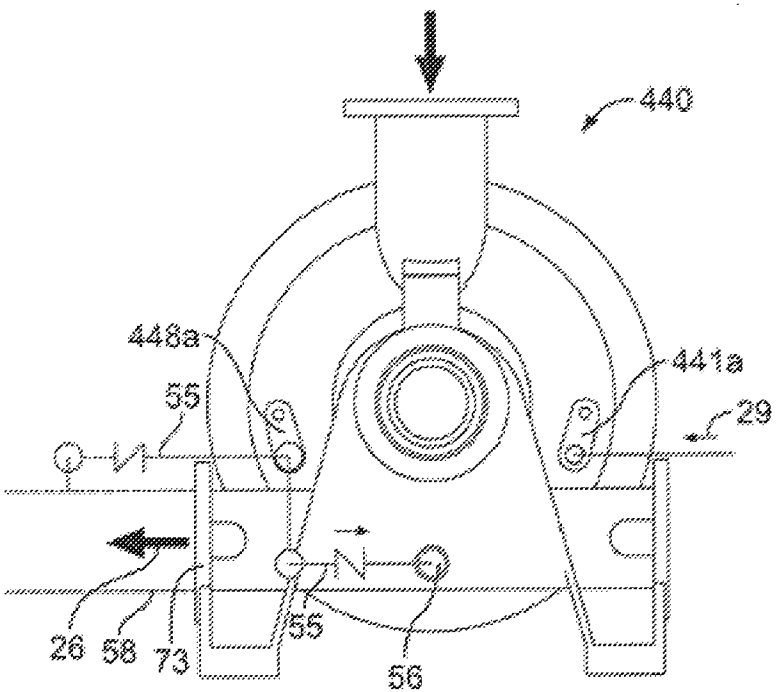
FIG. 10 is an end view of a reconfigured pump head of the type shown in FIG. 4.

To convert the pump shown in FIGS. 1 and 3 to a gas vented liquid ring pump, a new conical member 50, as shown in FIGS. 4, 7, 8 is provided. Additionally, the pump head 40 is reconfigured by possible machining and the like, such that the seal liquid introduction channel 48*a* is retasked to form a portion 448*a* of a gas vent passage. The new cone 50 forms another portion 448*b* of the gas vent passage. The cone passage 448*b* has a port 448*b*' through which gas to be vented enters the cone passage 448*b*. As shown in FIG. 10, the gas vent passage could also include piping 55 to allow gas exiting the retasked pump head 440, through passage 448*a*, to terminate at the pump discharge 56 or to terminate in a discharge piping system 58. Accordingly, the gas vent is formed by cone port 448*b*', cone gas channel 448*b*, head gas passage 448*a* and the piping 55. As can be seen the pump in FIG. 10 has a main discharge 73.

In providing a gas vent channel through a portion of the pump head 40 which was previously used as a portion of a sealing liquid introduction path, it is important to make sure the passageway provided has sufficient area for the release of gas from the working chamber. The smaller the passage, the greater the pressure required at the gas port 448*b*' and the greater the power required by the vacuum pump to achieve that pressure at port 448*b*. The higher power represents increased operating cost to the end user. Tests have shown that a ratio of pump capacity to passage area of 490 to 1,160 CFM per square inch results in an adequate passage cross sectional area. Preferably, no portion of the passage should have a restricted area outside of the desired ratio range.

As best seen in FIG. 8, for a cone 50 designed for operation at 20 inches of mercury vacuum that includes a single vent opening 448*b*', the leading edge 448*b*" of the opening in the cone should occur between 130 and 140 angular degrees before the point of closest approach of the rotor blade 25*a* to rotor body 23. The point of closest approach of the rotor body is approximated by line 60. The direction of rotation is shown by arrow 61. The angle of the closing edge 448*b*'" of the vent opening (port) 448*b*' is preferably from 110 to 115 angular degrees before the closest approach of the rotor to the body. The included angle from the closing of the vent opening to the opening of the cone's final discharge port 70 is approximately the angular distance between two successive rotor blades to a tolerance of 7 angular degrees. The inlet port is shown at 71.

Figure 9:
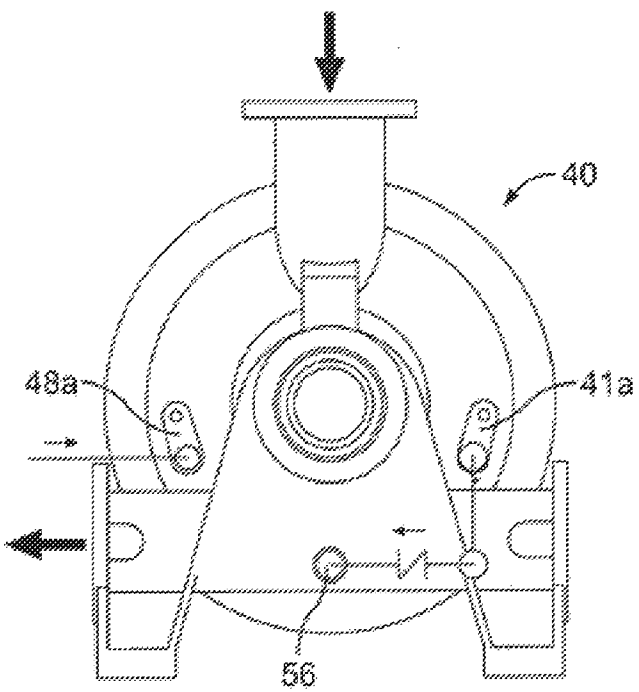
FIG. 9 (Prior Art)
FIG. 9 is an end view of a pump head of the type shown in FIG. 3.

The new cone 50 is provided with a sealing liquid channel 441*b* which allows for sealing liquid 29 to now enter the working chamber through what was previously used as a compressant vent channel 41*a*. A portion of the compressant vent channel 41*a* is thus retasked to be a sealing liquid introduction path 441*a*. Also pump 40 is reconfigured so that the compressant vent passage 41*a* is partially sealed at 41*a*'. Cone 50 seals the portion 41*a*' of vent passage 41*a* by providing a cone flange 444 that omits vent port 41*b*. The flange 444 thus seals vent portion 41*a* at 41*a*'. The path now retasked as the sealing liquid introduction path 441*a*, would be repiped as shown in FIGS. 9 and 10.

The term gas used herein is broad enough to include air.

Although an example of the invention has been disclosed, it will be appreciated by those skilled in the art that various changes and modifications might be made without departing from the spirit and scope of the invention.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

We claim:

1. A liquid ring pump comprising:

a pump head arranged to operate using liquid venting, the pump head defining a first aperture, a first body opening, a second body opening, a sealing liquid vent aperture, a second aperture, and a main discharge to be coupled with a discharge piping system; and a gas venting conical member coupled to the pump head to provide gas venting, the gas venting conical member including a central aperture arranged to introduce sealing liquid into the pump and a cone port arranged to direct venting gas into the gas venting conical member; and piping disposed external to the pump head, downstream of the first aperture, and upstream of the discharge piping system, wherein the venting gas then flows through the first body opening and then the first aperture before exiting the pump head through the piping and either re-entering the pump head from the piping or entering the discharge piping system from the piping, and wherein sealing liquid enters the pump by first flowing through the second aperture and then through the second body opening before entering the gas venting conical member and passing through the central aperture.

2. The liquid ring pump of claim 1, wherein the pump head includes a radial lip sized to receive a flange formed as part of the conical member.

3. The liquid ring pump of claim 1, wherein the conical member defines a first end arranged to abut the pump head, a second end spaced apart from the first end, and a conical wall extending between the first end and the second end, and wherein the cone passage is formed in the conical wall between the first end and the second end.

* * * * *